US012692632B2

(12) United States Patent
Sutton et al.

(10) Patent No.: US 12,692,632 B2
(45) **Date of Patent: *Jul. 28, 2026**

(54) RIPSTOP MATERIAL AND POOL COVER

(71) Applicant: LUMITE, INC., Alto, GA (US)

(72) Inventors: Alan Sutton, Gainesville, GA (US); Ron Rooks, Suwanee, GA (US); Greg Hendrix, Cleveland, GA (US)

(73) Assignee: LUMITE, INC., Alto, GA (US)

( * ) Notice: Subject to any disclaimer, the term of this patent is extended or adjusted under 35 U.S.C. 154(b) by 6 days.

This patent is subject to a terminal disclaimer.

(21) Appl. No.: 18/656,726

(22) Filed: May 7, 2024

(65) Prior Publication Data

US 2024/0287714 A1 Aug. 29, 2024

Related U.S. Application Data

(63) Continuation-in-part of application No. 17/670,964, filed on Feb. 14, 2022, now Pat. No. 12,006,599.

(60) Provisional application No. 63/149,411, filed on Feb. 15, 2021.

(51) Int. Cl.

| | |
|---|---|
| ***E04H 4/10*** | (2006.01) |
| ***D03D 1/00*** | (2006.01) |
| ***D03D 13/00*** | (2006.01) |
| ***D03D 15/283*** | (2021.01) |
| ***D03D 15/54*** | (2021.01) |

(52) U.S. Cl.

CPC ..... *D03D 13/004* (2013.01); *D03D 1/00* (2013.01); *D03D 15/283* (2021.01); *D03D 15/54* (2021.01); *E04H 4/10* (2013.01); *D10B 2321/022* (2013.01); *D10B 2401/06* (2013.01); *D10B 2505/18* (2013.01)

(58) Field of Classification Search

CPC ..... D03D 13/008; D03D 1/00; D03D 13/004; D03D 15/283; D03D 15/43; E04H 4/10; D10B 2505/18; D10B 2321/022

See application file for complete search history.

(56) References Cited

U.S. PATENT DOCUMENTS

| | | | | |
|---|---|---|---|---|
| 2,870,455 | A * | 1/1959 | Reeves | E04H 4/10 139/420 R |
| 3,354,472 | A | 11/1967 | Steinbeck | |
| 3,593,757 | A * | 7/1971 | Haynes | D03D 9/00 139/420 R |
| 6,179,013 | B1 * | 1/2001 | Gulya | D21F 1/0045 139/383 A |
| 6,886,187 | B2 | 5/2005 | Zell et al. | |
| 8,333,220 | B2 | 12/2012 | King | |

(Continued)

FOREIGN PATENT DOCUMENTS

| | | |
|---|---|---|
| FR | 2653811 | 10/1989 |
| GB | 2566451 | 3/2019 |
| SU | 2001172 | 2/1992 |

*Primary Examiner* — Robert H Muromoto, Jr.

(74) *Attorney, Agent, or Firm* — Perilla Knox & Hildebrandt LLP

(57) ABSTRACT

A woven fabric material including an array of machine direction yarns and cross-machine direction yarns. The array includes larger denier yarns arranged in an alternating pattern with smaller denier yarns in both the machine direction and the cross-machine direction. The array of machine direction yarns and cross-machine direction yarns is arranged to allow water to pass freely through the woven fabric material.

27 Claims, 3 Drawing Sheets

(56) References Cited

U.S. PATENT DOCUMENTS

| | | | | |
|---|---|---|---|---|
| 9,777,455 | B2 * | 10/2017 | Sutton | D03D 15/46 |
| 10,024,022 | B2 | 7/2018 | Booth | |
| 12,006,599 | B2 * | 6/2024 | Sutton | D03D 13/008 |
| 2005/0055760 | A1 | 3/2005 | Sutton et al. | |
| 2008/0086808 | A1 | 4/2008 | Sutton et al. | |
| 2019/0203434 | A1 * | 7/2019 | Segroves | E01F 7/02 |

* cited by examiner

RIPSTOP MATERIAL AND POOL COVER

CROSS-REFERENCE TO RELATED APPLICATION

This application is a continuation-in-part of U.S. patent application Ser. No. 17/670,964 filed Feb. 14, 2022, which claims the benefit of U.S. Provisional Patent Application Ser. No. 63/149,411 filed Feb. 15, 2021, both of which are hereby incorporated herein by reference for all purposes.

TECHNICAL FIELD

The present invention relates generally to the field of materials, and more particularly to a woven fabric material that is resistant to tearing and wear and that allows passage of water through the material, and further, to a pool cover at least partially formed of such material.

BACKGROUND

Various "ripstop" materials have been developed to provide improved resistance to tearing. Many such fabrics are made with a woven scrim and then coated with polyethylene (PE), polyvinyl chloride (PVC), or other coating materials. In a typical coated ripstop fabric, the scrim that is coated uses the same size yarn in both the machine and cross-machine direction. Such coated fabrics typically do not allow water to pass through a sheet of the material well without some type of screen being sewn into the fabric. The material of the screen may not be as tear or wear resistant as the ripstop material, resulting in diminished performance of products made from a combination of the ripstop and screen materials.

In particular applications, for example swimming pool covers, both water passage and tear and wear resistance are desired. As such, pool covers made from typical coated ripstop fabrics may not provide the desired water passage, and water may puddle on the cover. Screens added to the cover to allow water passage may be more prone to tearing and wear damage than desired and can allow leaves or other debris to pass through tears or holes worn in the material of the cover. In some instances, the use of a pump may be required for removing water from an installed pool cover made from a material that does not allow water passage, which creates inconvenience and expense for the user.

Other ripstop materials have been developed that allow water to pass through the material. These fabrics, however, have employed several types of yarn within the same material. For example, some materials have used monofilament yarns in combination with spaced apart bands comprised of multifilament yarns. These and other modifications may add to the complexity and cost of manufacturing the material. Multifilament threads may even impede the passage of water through the material, which may again create and inconvenience and expense for the user.

Accordingly, it has been found that needs exist for improved materials and improved pool cover products. It is to the provision of improved materials and improved pool covers meeting these and other needs that the present invention is primarily directed.

SUMMARY

In example embodiments, the present invention provides a woven ripstop material having resistance to damage by tearing and/or abrasive wear, and that allows water to pass through the fabric. In further example embodiments, the invention provides a swimming pool cover at least partially formed of such a material.

In one aspect, the present invention relates to a woven material comprising an array of machine direction yarns and cross-machine direction yarns, wherein the machine direction yarns comprise a repeating warp pattern of eight smaller denier warp yarns and two larger denier warp yarns, and wherein the cross-machine direction yarns comprise a repeating weft pattern of four smaller denier weft yarns and two larger denier weft yarns.

In another aspect, the invention relates to a woven fabric material comprising an array of machine direction yarns and cross-machine direction yarns, with larger denier yarns arranged in an alternating pattern with smaller denier yarns in both the machine direction and the cross-machine direction, wherein the material allows water to pass freely therethrough.

In another aspect, the invention relates to a woven fabric material comprising an array of machine or warp direction yarns and cross-machine or weft direction yarns, with larger denier yarns alternating with the smaller denier yarns of the same yarn type in both the machine and cross-machine direction, allowing water to pass freely therethrough.

In another aspect, the invention relates to a pool cover having a first alternating pattern of monofilament yarns in a warp direction and a second alternating patterns of monofilament yarns in a weft direction. The first and second alternating patterns comprise smaller and larger monofilament yarns, the larger monofilament yarns being of a larger denier than the smaller monofilament yarns. Additionally, gaps provided between the monofilament yarns allow water to pass freely therethrough.

These and other aspects, features and advantages of the invention will be understood with reference to the drawing figures and detailed description herein and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

As briefly described above, embodiments of the present invention are directed to a woven material that provides protection from wear and tearing while allowing the passage of water. The woven material may be comprised of machine direction and cross-machine direction yarns. Within each direction, the yarns may have differing deniers or sizes. Larger denier yarns in both the machine and cross-machine directions are placed in intervals with a number of intervening smaller denier yarns. The larger denier yarns add strength to the materials and wear and tear resistance, as they are more capable of withstanding abuse. The larger yarns also aid in water passage as the intersection of larger denier yarns with other yarns tend to form larger gaps through which water may pass than intersections with smaller denier yarns. Moreover, the yarns in the material may all be monofilament yarns, which may provide better water passage as multifilament yarns may spread or flatten over time, reducing the open areas in the woven material where water may pass therethrough. The woven material may be placed over an object or opening needing to be covered, so that the woven material protects the object or opening from debris while allowing water to pass therethrough.

Figure 1:
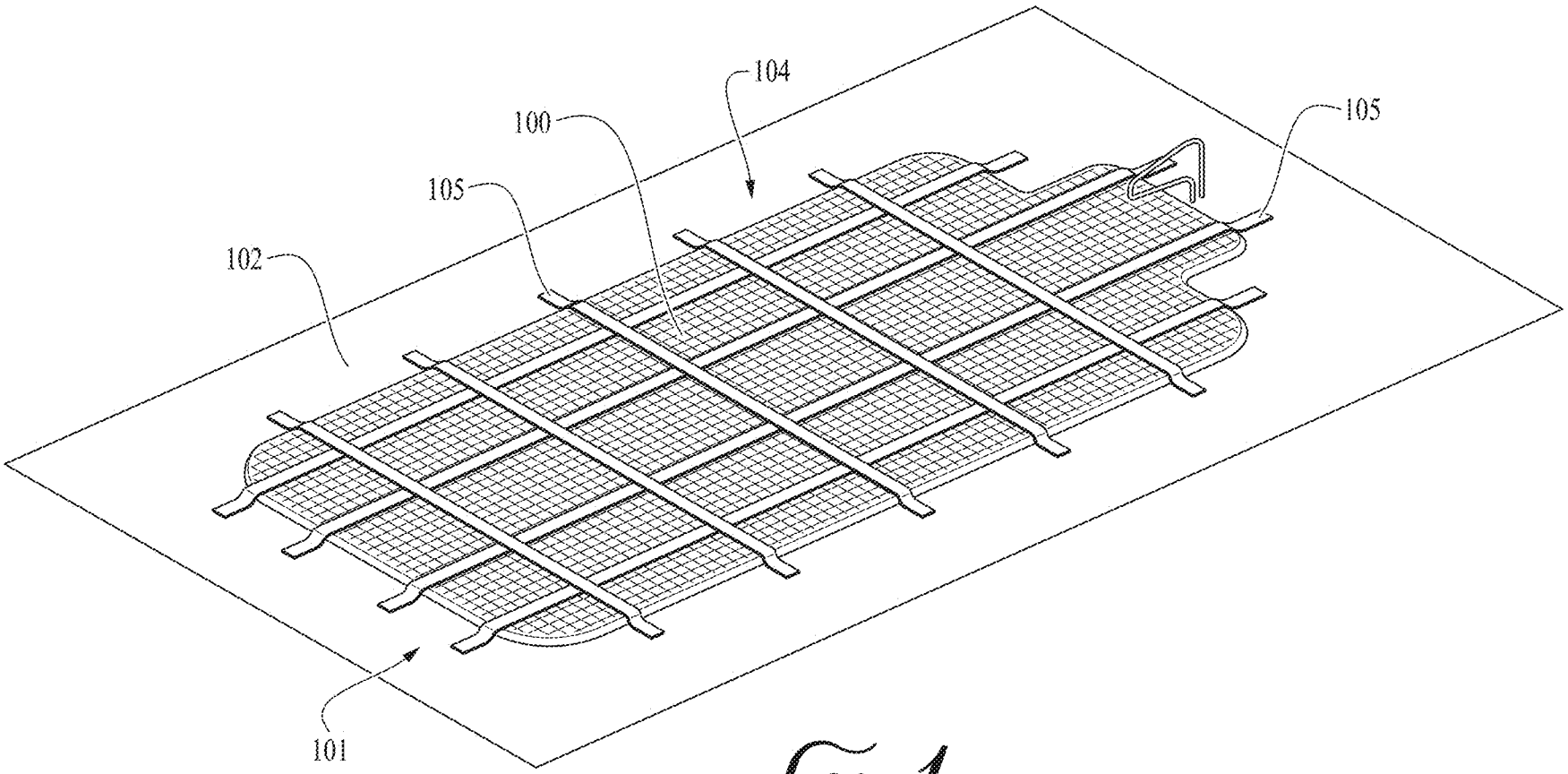
FIG. 1 shows a swimming pool cover made of a woven material according to an example embodiment of the present invention.
Figure 2:
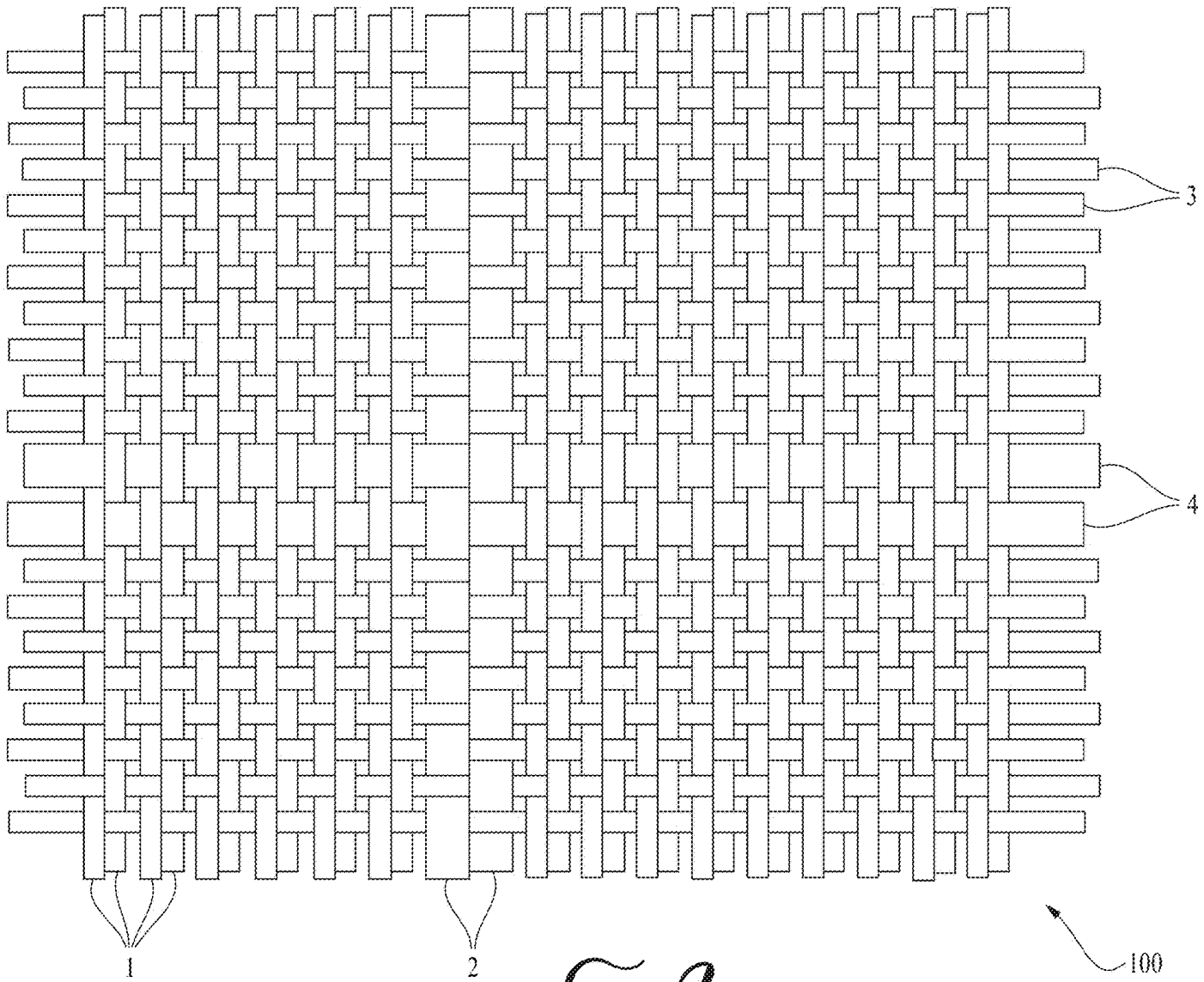
FIG. 2 shows a section of a woven material according to an example embodiment of the present invention.
Figure 3:
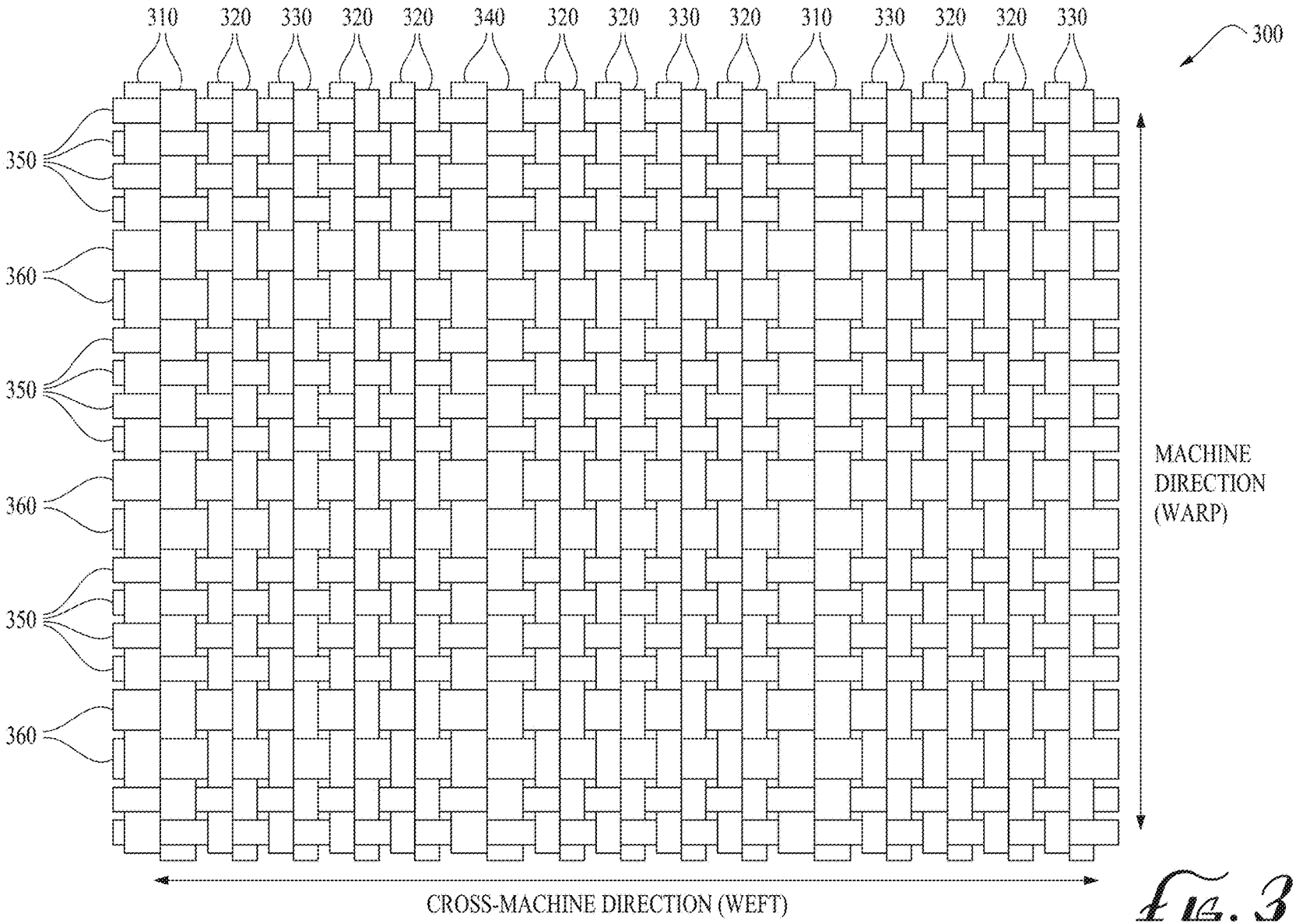
FIG. 3 shows a section of a woven material according to another example embodiment of the present invention.

With reference now to the drawing figures, wherein like reference numbers represent corresponding parts throughout the several views, FIG. 1 shows a swimming pool cover made of a woven material according to an example embodiment of the present invention, and FIGS. 2 and 3 show sections of woven materials according to example embodiments of the present invention.

FIG. 1 shows an example of woven material 100 being used as a cover 104 for the pool 101. The woven material 100 is preferably uncoated and preferably allows water to freely pass through substantially the entire surface of the cover 104, or at least a significant portion of it. In this manner, rainwater preferably will not puddle on top of the cover 104 but will pass through the cover 104 into the pool 101, while leaves and other debris will remain on top of cover 104 for easy removal.

In FIG. 1, cover 104 is sized so that its edges lie on pool deck 102 while having the same general shape as that of pool 101. In other examples, cover 104 may be a sheet of the woven material in a rectangular, circular, oval, or other regular or irregular shape. Woven material 100 may be custom cut to fit a specified pool, object, or opening, or alternatively, various standard shapes and sizes of cover 104 may be provided. Cover 104 may also be shaped so that it fits within a pool or opening, or such that multiple covers may be used in conjunction with each other to cover a pool, object, or opening.

Optionally, one or more attachments, anchors, ties, or other means for securing pool cover 104 in place over pool 101 may be attached to the sheet of woven material 100. For example, the pool cover may include one or more straps or belts sewn onto the woven material for securing the pool cover to edges or anchor points positioned about or adjacent the pool. In example embodiments, a plurality of straps 105 is provided in both longitudinal and lateral directions creating a grid-like pattern across the woven material. In preferred embodiments, the straps 105 are positioned substantially perpendicular to the edges of the pool cover and in three-foot increments in both directions. However, other increments and/or arrangements may be incorporated as applicable. In other example embodiments, straps may be provided along one direction (e.g., a set of parallel straps) or in more than two directions across the woven material (e.g., in a web-like array).

Optionally, woven material 100 may also have a lower density than water, so that the pool cover 104 will float on top of the water in pool 100 without additional support. Alternatively, or additionally, one or more floats or buoyant sections may be attached to, incorporated in, or placed below pool cover 104, to increase it buoyancy.

In further alternate example embodiments, the woven material 100 may be used to manufacture other products in addition to pool covers, such as for example trampoline mats and agriculture shade cloth.

FIG. 2 shows an example section of woven material 100. Within FIG. 2, woven material 100 is comprised of smaller denier machine direction yarns 1, larger denier machine direction yarns 2, smaller denier cross-machine direction yarns 3, and larger denier cross-machine direction yarns 4 arranged in an array. The larger denier machine direction yarns 2 and the larger denier cross-machine direction yarns 4 appear as a grid pattern within woven material 100. In FIG. 2, woven material 100 utilizes a plain weave. In alternate embodiments, other weave patterns such as for example twill, basket, and/or other suitable weave patterns may be used.

The yarns of material 100 may all be of the same type of yarn and made from the same material, but not all the same deniers. For example, woven material 100 may be made of monofilament polypropylene yarns, but the larger denier machine direction yarns 2 and larger denier cross-machine direction yarns 4 may be of a larger denier or thickness than smaller denier machine direction yarns 1 and smaller denier cross-machine direction yarns 3.

For example, the woven material 100 may be comprised of an alternating pattern or array of smaller denier machine direction yarns 1 made of monofilament 525 denier yarns and larger denier machine direction yarns 2 made of monofilament 1000 denier yarns. Woven material 100 may also be comprised of an alternating pattern of smaller denier cross-machine direction yarns 3 made of monofilament 565 denier yarns and larger denier cross-machine direction yarns 4 made of monofilament 925 denier yarns.

In other example embodiments, smaller denier machine direction yarns 1 and smaller denier cross-machine direction yarns 3 may be of the same denier or thickness. In some embodiments, larger denier machine direction yarns 2 and larger denier cross-machine direction yarns 4 may additionally or alternatively be of the same denier or thickness, but of different denier or thickness than that of smaller denier machine direction yarns 1 and smaller denier cross-machine direction yarns 3.

In particular example embodiments, the beaming and weaving specification of woven material 100 may comprise larger denier machine direction yarns 2 placed in 1" interval across the warp. This may create a pattern of thirty-six smaller denier machine direction yarns 1 for every two yarns of larger denier machine direction yarns 2. The weaving and beaming specification for woven material 100 may also be comprised of larger denier cross-machine direction yarns 4 placed in 1" intervals across the length of the fabric. This may create a pattern of eighteen smaller denier cross-machine direction yarns 3 for every two larger denier cross-machine direction yarns 4. When such specifications are used, the yarns in the machine direction may be 70% stronger every one inch, and the yarns in the cross-machine direction may be 60% stronger every one inch, resulting in the improved ripstop performance of woven material 100. In other embodiments, other configurations and patterns of machine direction and cross-machine direction yarns may be used, resulting in different performance specifications of woven material 100.

In other example embodiments, there may be one larger denier machine direction yarn 2 for a given interval of smaller denier yarns 1. In different embodiments there may be three or more larger denier machine direction yarns 2 for a given interval of smaller denier yarns 1. Similarly, some embodiments may have one, two, three, or more larger denier cross-machine direction yarns 4 for a given interval of smaller denier cross-machine direction yarns 3.

In another example, there may be one larger denier yarn machine direction yarn 2 for every smaller denier yarn 1. In the same or different embodiment, there may be one larger denier cross-machine direction yarn 4 for every smaller denier cross-machine direction yarn 3.

In some example embodiments, the tensile strength of the smaller denier machine direction yarns 1 may be about 6-8 lbs., or preferably about 7.0 lbs., and the tensile strength of the larger denier machine direction yarns 2 may be about 11-13 lbs., or preferably about 11.9 lbs. In those and other embodiments, the tensile strength of the smaller denier cross-machine direction yarns 3 may be about 6-9 lbs., or preferably about 7.7 lbs. and the tensile strength of the larger denier cross-machine direction yarns 4 may be about 11-13 lbs., or preferably about 12.4 lbs. In other embodiments, the tensile strength of the yarns may be different.

FIG. 3 shows a section of another example woven ripstop material 300, substantially similar to the previously described embodiment except as noted, and also adaptable for use in construction of a pool cover and other applications substantially as previously described, with differences in the weave pattern and constituent yarns as shown and described. In particular examples, the material 300 comprises a fabric having a repeating pattern in the warp or machine direction with a smaller denier warp yarn such as a 525 denier yarn 320 (black) or 330 (color) for eight yarns and then two larger denier warp yarns such as 1000 denier yarns 310 (black) or 340 (color). The colors of these yarns can be either green, blue, tan, gray or black and/or any combinations thereof. In alternate embodiments, all of the yarns may be black, colored, or any combinations and variations thereof. The woven material 300 may comprise a plain weave, or alternatively other weave patterns such as for example twill, basket, and/or other weave patterns. The machine direction yarns and the cross-machine direction yarns may comprise polypropylene yarns, polyester yarns, polyethylene yarns, nylon yarns, or combinations thereof. In particular example embodiments, the total warp yarns per inch is about 39, and the larger warp yarn repeat pattern is approximately every 0.20".

This is an example of the pattern in the warp direction:

| warp | | # of yarns for each size and color. Pattern approx. ½" | | | | | | | | | | | | | | | |
|---|---|---|---|---|---|---|---|---|---|---|---|---|---|---|---|---|---|
| MV 2100000469 PP10 525F (Color) | Color | | | 2 | | | | | 2 | | | | | 2 | | | 2 |
| MV 2100001870 PP10 525F RPL10 | Black | | 2 | | | 4 | | 4 | | | 2 | | | | | 4 | |
| MV 2100002001 PP10 1000F RPL10 | Black | 2 | | | | | | | | | | | 2 | | | | |
| MV 210000XXXX PP10 1000F (Color) | Color | | | | | | 2 | | | | | | | | | | |
| | | Repeat Pattern Depends on Width | | | | | | | | | | | | | | | |

In the weft or cross-machine pattern, the repeat pattern is four smaller denier weft yarns such as yarns of 565 or 600 denier and then two larger denier weft yarns such as 925 denier yarns. In particular example embodiments, the total weft yarns per inch in the woven fabric is about 20, and the larger weft yarn repeat pattern is approximately every 0.20". The weft yarns may be black, colored, or combinations thereof.

This is an example of the pattern in the weft direction:

| weft | | | |
|---|---|---|---|
| MV 2100001988 6802 | PP01 600 | Black | 4 picks of 665 denier yarn then 2 picks of 925 |
| MV 2100001969 925 RPL10 | PP01 | Black | denier for a repeating pattem |

Example embodiments of material as disclosed have improved or increased (relative to previous versions of similar materials) the warp direction tensile strength by about 13%-15% and the weft direction tensile strength by about 25%-29%; and improved or increased warp tear strength by about 10%, and weft tear strength by about 4%-5%.

Alternate embodiments of woven materials 100, 300 may comprise yarns or fibers of one or more different polymers to increase the strength of yarns that are the same size. For example, polyester, polyethylene and/or nylon yarns may be used in place of one or more of the polypropylene yarns in the weave pattern. Various treatments and/or weave modifications may also be incorporated to accommodate fibers or yarns of different heat shrinkage profiles. Other example embodiments of woven material 100, 300 may comprise other types of yarns, such as multifilament yarns or other suitable yarns.

While the invention has been described with reference to example embodiments, it will be understood by those skilled in the art that a variety of modifications, additions and deletions are within the scope of the invention, as defined by the following claims.

What is claimed is:

1. A woven material comprising an array of machine direction yarns and cross-machine direction yarns, wherein the machine direction yarns comprise a repeating warp pattern of eight smaller denier warp yarns and two larger denier warp yarns, and wherein the cross-machine direction yarns comprise a repeating weft pattern of four smaller denier weft yarns and two larger denier weft yarns.

2. The woven material of claim 1, wherein the smaller denier warp yarns comprise approximately 525 denier yarns and the larger denier warp yarns comprise approximately 1000 denier yarns.

3. The woven material of claim 2, wherein the smaller denier weft yarns comprise approximately 565 denier yarns and the larger denier weft yarns comprise approximately 925 denier yarns.

4. The woven material of claim 1, wherein the machine direction yarns comprise both black and colored yarns.

5. The woven material of claim 4, wherein the colored yarns are selected from green, blue, tan, gray, or combinations thereof.

6. The woven material of claim 1, wherein the machine direction yarns comprise a repeating pattern of two black 1000 denier yarns, two black 525 denier yarns, two colored 525 denier yarns, four black 525 denier yarns, two color 1000 denier yarns, four black 525 denier yarns, two color 525 denier yarns, two black 525 denier yarns, two black 1000 denier yarns, two colored 525 denier yarns, four black 525 denier yarns, and two colored 525 denier yarns.

7. The woven material of claim 1, wherein the machine direction yarns and cross-machine direction yarns are selected from polyester yarns, polyethylene yarns, nylon yarns, polypropylene yarns, or combinations thereof.

8. The woven material of claim 1, wherein the machine direction yarns and cross-machine direction yarns comprise monofilament polypropylene yarns.

9. The woven material of claim 1, comprising approximately 39 machine direction yarns per inch.

10. The woven material of claim 1, wherein the repeating warp pattern has a spacing of about 0.20 inches between each set of two larger denier warp yarns.

11. The woven material of claim 1, comprising approximately 20 cross-machine direction yarns per inch.

12. The woven material of claim 1, wherein the repeating weft pattern has a spacing of about 0.20 inches between each set of two larger denier weft yarns.

13. The woven material of claim 1, wherein the material allows water to pass freely therethrough.

14. A swimming pool cover at least partially comprising the woven material of claim 1.

15. A woven fabric material comprising an array of machine direction yarns and cross-machine direction yarns, wherein:

the machine direction yarns comprise a repeating warp pattern in which a plurality of smaller denier warp yarns are arranged consecutively as a group and a plurality of larger denier warp yarns are arranged consecutively as a group, the groups alternating along the warp direction; and the cross-machine direction yarns comprise a repeating weft pattern in which a plurality of smaller denier weft yarns are arranged consecutively as a group and a plurality of larger denier weft yarns are arranged consecutively as a group, the groups alternating along the weft direction.

16. The woven fabric material of claim 15, wherein the machine direction yarns and cross-machine direction yarns at least partially comprise polypropylene yarns, polyester yarns, polyethylene yarns, nylon yarns, or combinations thereof.

17. The woven fabric material of claim 15, wherein the smaller denier warp yarns comprise approximately 525 denier yarns and the larger denier warp yarns comprise approximately 1000 denier yarns.

18. The woven fabric material of claim 15, wherein the smaller denier weft yarns comprise approximately 565 denier yarns and the larger denier weft yarns comprise approximately 925 denier yarns.

19. A swimming pool cover at least partially comprising the woven fabric material of claim 15.

20. The woven fabric material of claim 15, wherein the machine direction yarns comprise both black and colored yarns.

21. The woven fabric material of claim 15, wherein the colored yarns are selected from green, blue, tan, gray, or combinations thereof.

22. The woven fabric material of claim 15, wherein the machine direction yarns and the cross-machine direction yarns comprise monofilament polypropylene yarns.

23. The woven fabric material of claim 15, wherein the group of the plurality of smaller denier warp yarns comprises more individual yarns than individual yarns of the group of the plurality of larger denier warp yarns.

24. The woven fabric material of claim 15, wherein the group of the plurality of smaller denier weft yarns comprises more individual yarns than individual yarns of the group of the plurality of larger denier weft yarns.

25. The woven fabric material of claim 15, wherein the material allows water to pass freely therethrough.

26. The woven fabric material of claim 15, wherein:

the group of the plurality of smaller denier warp yarns comprises two black denier warp yarns, two color denier warp yarns, two black denier warp yarns, and two black denier warp yarns, for a total of eight smaller denier warp yarns; and the group of the plurality of larger denier warp yarns comprises two black denier warp yarns or two color denier warp yarns, for a total of two larger denier warp yarns.

27. The woven fabric material of claim 15, wherein:

the group of the plurality of smaller denier weft yarns comprises four black denier weft yarns; and the group of the plurality of larger denier weft yarns comprises two black denier weft yarns or two color denier weft yarns, for a total of two denier weft yarns.

* * * * *